United States Patent [19]

Hamilton

[11] 3,968,357

[45] July 6, 1976

[54] ILLUMINATED EARRING WHICH IS SWITCHED ON BY SECUREMENT TO THE EAR

[75] Inventor: Eric Hamilton, Culver City, Calif.

[73] Assignee: Lawrence Peska Associates, Inc., New York, N.Y. ; a part interest

[22] Filed: Oct. 29, 1975

[21] Appl. No.: 626,828

[52] U.S. Cl. ..... 240/6.4 W; 63/1 R; 200/52 R; 200/DIG. 2

[51] Int. Cl.² ..... F21V 33/00

[58] Field of Search ..... 63/1 R, 14 R; 240/6.4 W, 6.4 R, 10 R, 59; 200/52 R, DIG. 2

[56] References Cited

UNITED STATES PATENTS

| | | | |
|---|---|---|---|
| 2,265,670 | 12/1941 | Platt | 240/59 |
| 2,842,628 | 7/1958 | James | 200/52 R |
| 3,316,396 | 4/1967 | Trott et al. | 240/6.4 R |
| 3,383,503 | 5/1968 | Montgomery | 240/59 |
| 3,384,740 | 5/1968 | Wood | 63/14 R X |
| 3,524,030 | 8/1970 | Wiegel | 200/52 R |
| 3,586,798 | 6/1971 | Holmes | 200/52 R |
| 3,689,758 | 9/1972 | Power | 240/6.4 W |

*Primary Examiner*—F. Barry Shay
*Attorney, Agent, or Firm*—Jack D. Slobod

[57] ABSTRACT

A multi-facetted translucent ball surrounds a lamp which is suspended from an earring clip by a flexible tubular metal shaft which has a wire running there through. The earring clip is U-shaped and has a pair of opposed legs which are spread resiliently apart when the clip is engaged on ear with the lobe between the legs. One leg carries, connected to the wire, a cup for holding a wafer battery. A U-shaped support secured to the clip carries a contact opposite the cup in a position so that the cup is urged toward the contact for engaging opposite terminals of the battery upon spreading of the clip.

3 Claims, 4 Drawing Figures

ILLUMINATED EARRING WHICH IS SWITCHED ON BY SECUREMENT TO THE EAR

FIELD OF THE INVENTION

The present invention relates generally to illuminated battery powered earrings. In its particular aspects the present invention relates to the provision of a battery holder on an illuminated earring which is configured to switchably engage a battery in response to the application of clamping force about an ear.

BACKGROUND OF THE INVENTION

The prior art is aware of various illuminated battery powered earrings some of which utilize battery holders on the earring and some of which utilize battery holders which are positioned remotely of the earring such as in the hair of the wearer. Illustrative of the prior art in this regard are U.S. Pat. Nos. 3,383,503; 3,384,740; 3,689,758; and 3,814,926.

Particularly in the type of lighted earring which carries a battery holder there is a problem in providing a simple and effective electrical switch. There is a further problem that due to the necessarily relatively small size and capacity of the battery used with such an earring the battery is readily used up if one forgets to turn the switch off when the earring is removed.

OBJECTS OF THE INVENTION

It is an object of the present invention to provide illuminated earrings of the type having an integral battery holder which includes automatic switch means responsive to whether or not the earring is engaged on an ear.

It is a further object of the present invention to provide a simple and effective combined battery holder and switch for a lighted earring.

It is yet another object of the present invention to provide a decorative illuminated member supported pendently from an earring clip by a decorative flexible tubular ground conductor which serves as a conduit for a wire coupled to the lamp.

SUMMARY OF THE INVENTION

Briefly, the aforementioned and other objects of the present invention are satisfied by providing an illuminated earring which includes a resilient U-shaped earring clip having a pair of opposed legs which are urged apart when the ear lobe is clamped therebetween.

To provide a switch responsive to the clamping of the earlobe, a first contact of a battery holder is carried on the end of one of the legs. A second contact for the battery holder is positioned opposite the first contact in a manner that the first contact is urged toward the second as the legs are spread apart. Further, the first contact is configured as a cup for functionally engaging the battery to trap the battery between the contacts. As the first contact is urged toward the second in response to the clamping of the ear lobe, the battery is carried into engagement with the second contact to complete an electrical circuit to a lamp carried pendently from the clip.

The lamp is located within a decorative translucent multi-facetted ball for producing sparkling lighting effects. The ball is suspended from the clip by a decorative tubular metal flexible shaft which serves both as a ground conductor for the lamp coupled to one of the contacts and as a conduit in which a wire runs from the lamp to the other contact of the battery holder.

Other objects, features and advantages of the present invention will become apparent upon perusal of the following detailed description of the preferred embodiment thereof when taken in conjunction with the appended drawing wherein.

DETAILED DESCRIPTION

Figure 1:
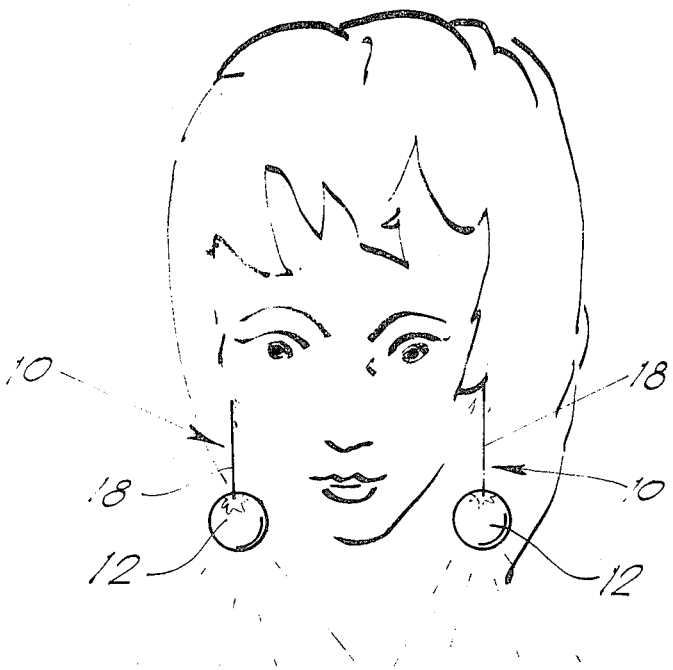
FIG. 1 is a front view of an individual wearing a pair of earrings of the present invention.

Referring to FIGS. 1 through 4 of the drawing, the earring of the present invention is generally indicated by the reference numeral 10. Earring 10 comprises a multi-facetted colored translucent ball 12 having a central bore 14 running therethrough. Within bore 14 there is positioned a miniature incandescent lamp 16 which when electrically energized produces a sparkling light output due to the facets of the ball 12.

The ball 12 is suspended from a decorative flexible tubular metal shaft 18 which may be woven of metal strips (not shown). At a lower end of shaft 18, there is formed a decorative socket 20 in which ball 12 is adhesively secured with bore 14 in line with the shaft. One lead 22 from lamp 16 is connected to shaft 18 so that the shaft may serve as a ground conductor for energizing the lamp while the other lead 24 of the lamp is connected to an insulated wire 26 which runs upward through the interior of shaft 18 and exits from the top of the shaft.

The upper part of shaft 18 is brazed at 28 to the center of a metal U-shaped support member 30. One end of support member 30 is joined at 32 to the end 35 of a U-shaped metal earring clip 34 which threadably carries the ear engaging screw 36. As should be apparent from the drawing the U-shaped support member 30 is larger than clip 34 and is positioned in the same plane as the clip.

Earring clip 34 is a wire-formed member which provided of sufficient flexibility and resiliency that the opposed legs 35 and 38 of the clip are elastically spread apart when the clip is engaged about an ear lobe 39. This aspect may be appreciated upon comparing the position of the various parts in FIGS. 3 and 4. As will be understood as the discussion proceeds this spreading apart of the legs 35 and 38 when the ear lobe 39 is properly clamped between screw 36 and end 38 is utilized to control a switch for automatically completing a circuit to lamp 16 only when the earring 10 is being worn.

The end 38 carries a cylindrical metal cup 40 which faces opposite screw 36. End 38 is however electrically insulated from cup 40 by bushing or washer means 42 which prevents a rivet 44 joining the end 38 and the cup from making electrical contact with the end 38. Within the cup 40 there is a positioned a wafer type battery 46. The cup 40 is preferably dimensioned to frictionally engage the cicumference of battery 46. By engaging the circumference of battery 46, the cup 40 makes contact with one terminal thereof. The cup 40 is electrically connected to wire 26 at 48. Further, the battery 46 has a central terminal 50 facing out of the cup 40.

Figure 4:
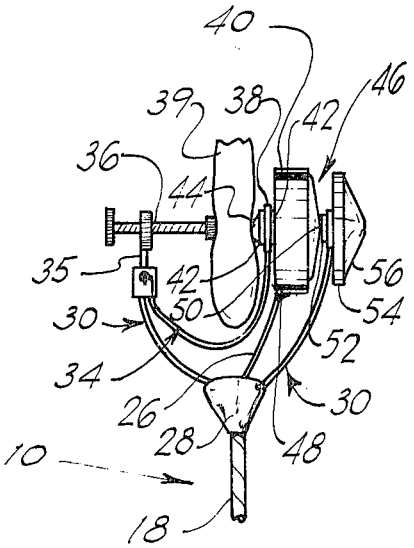
FIG. 4 is a side view of the upper part of the earring of FIGS. 2 and 3 but with the parts thereof positioned as when the earring is worn.
Figure 3:
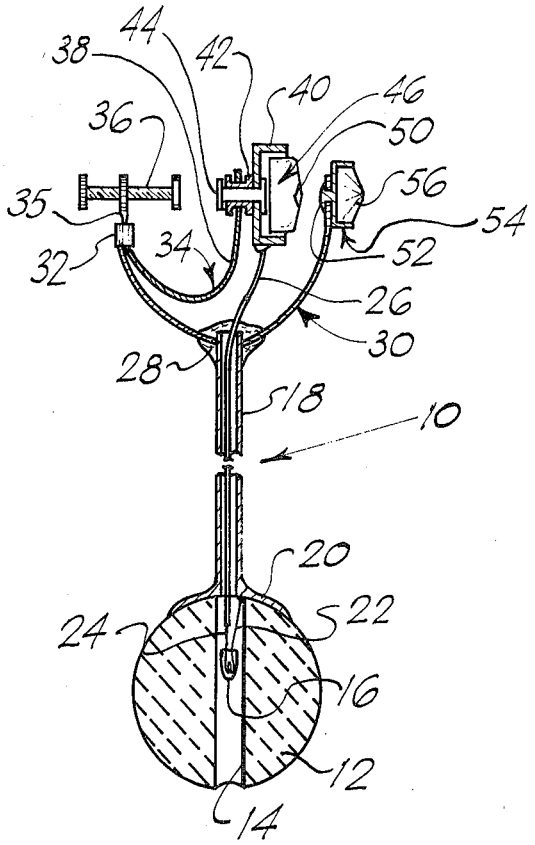
FIG. 3 is an elevational cross-sectional side view of the earring of FIG. 2 with the parts thereof positioned as when the earring is not worn.
Figure 2:
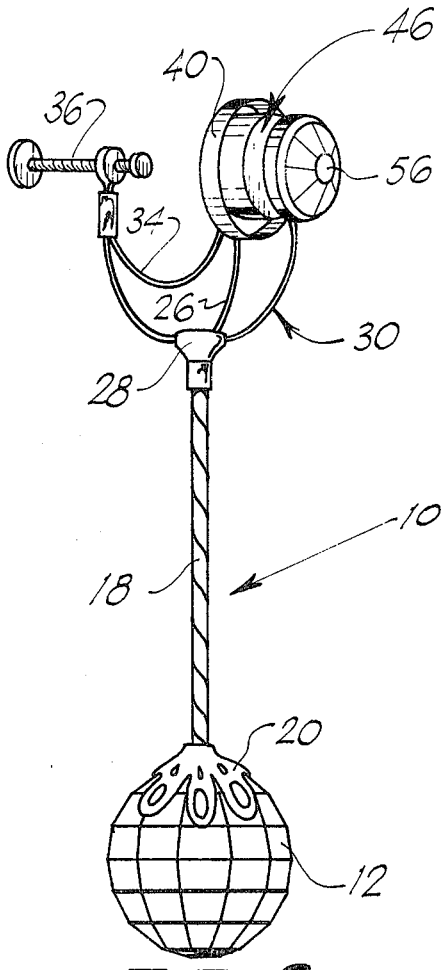
FIG. 2 is enlarged pictorial presentation, generally in elevation, of an earring of FIG. 1.

The support member 30 runs to a position opposite cup 40 where a contact 52 is formed located spaced from terminal 50. The contact 52 is associated with a holder 54 for an outwardly facing ornamental jewel 56. As shown in FIG. 4, when the legs 35 and 38 are spread apart as the screw 36 is tightened against ear lobe 39, the cup 40 moves toward contact 52 to carry the battery terminal 50 into engagement with contact 52. This action completes a ground path from terminal 52 through support number 30 and shaft 18 for energizing lamp 16.

It should now be apparent that the cup 40 and contact 52 define a battery holder for trapping battery 46 therebetween without normally making electrical contact with the opposite battery terminals. In response to force clamping the ear lobe 39 in clip 34, the battery holder is compressed in a manner that both terminals of the battery are engaged for completing a circuit to the lamp 16.

While the preferred embodiment of the present invention has been described in specific detail, it should be understood that numerous modifications, additions and omissions in the details thereof are possible within the intended spirit and scope of the invention claimed herein.

What is claimed is:

1. An illuminated earring comprising: means for engaging the ear to secure the earring thereto, said means including a resilient U-shaped earring clip having a pair of opposed legs which are urged apart upon engaging an ear therebetween; a first electrical contact carried on one of said legs; a second electrical contact; a support secured to the earring clip carrying said second contact and maintaining it spaced opposite said first contact in a manner for said first contact to be urged toward and into contact with said second contact upon said engagement of the ear by said clip; said first and second contacts being configured and positioned for capturing a wafer battery therebetween and for contacting opposite terminals of said battery when said first contact is urged toward said second contact by said engagement with the ear; a lamp; means for carrying said lamp pendant from said support; and conductor means electrically coupling said first and second contacts to said lamp.

2. The earring of claim 1 wherein said carrying means comprises an elongated flexible tubular metal shaft and wherein said conductor means comprises said shaft and a wire running within the interior of said shaft.

3. The earring of claim 2 further comprising a multifacetted translucent member surrounding said lamp.

* * * * *